US007841356B2

(12) United States Patent
Shires

(10) Patent No.: US 7,841,356 B2
(45) Date of Patent: Nov. 30, 2010

(54) STRUT AND ARCH STRUCTURE FOR TENT

(76) Inventor: Henry C. Shires, 12213 Koswyn Ct., Nevada City, CA (US) 95959

( * ) Notice: Subject to any disclaimer, the term of this patent is extended or adjusted under 35 U.S.C. 154(b) by 0 days.

(21) Appl. No.: 12/273,773

(22) Filed: Nov. 19, 2008

(65) Prior Publication Data

US 2010/0243014 A1 Sep. 30, 2010

(51) Int. Cl.
*E04H 15/36* (2006.01)
*E04H 15/32* (2006.01)

(52) U.S. Cl. ..... 135/136; 135/125; 135/119; 135/120.4; 135/156

(58) Field of Classification Search ..... 135/97, 135/124, 136–138, 156, 118–119, 120.3–120.4, 135/125
See application file for complete search history.

(56) References Cited

U.S. PATENT DOCUMENTS 1,730,565 A * 10/1929 Flintjer ..... 135/87
2,114,061 A * 4/1938 Robinson ..... 135/97
3,371,671 A * 3/1968 Kirkham ..... 135/139
3,834,410 A * 9/1974 Leibel ..... 135/123
4,078,572 A * 3/1978 Moss ..... 135/97
4,165,757 A * 8/1979 Marks ..... 135/93
4,352,362 A * 10/1982 Nichols ..... 135/98
4,944,322 A * 7/1990 Gillis ..... 135/153
5,662,134 A * 9/1997 Auer ..... 135/156
D397,400 S * 8/1998 Bury et al. ..... D21/834
6,021,796 A * 2/2000 Vavra ..... 135/147
6,354,317 B1 3/2002 Lah
7,267,135 B2 * 9/2007 Hardee et al. ..... 135/116

FOREIGN PATENT DOCUMENTS

JP 2001090390 A * 4/2001

OTHER PUBLICATIONS

Moontrail, Hilleberg Akto mountaineering tent, Moontrail catalog webpage, Feb. 6, 2006 (with photos dated to 2003), 4 pages, www.moontrail.com, U.S.
Moontrail, Exped Vela Extreme 3 Season 1 person tent, Moontrail catalog webpage, Feb. 10, 2006 (with photos dated 2004), 3 pages, www.moontrail.com, U.S.

(Continued)

*Primary Examiner*—Winnie Yip
(74) *Attorney, Agent, or Firm*—Northern Michigan Patent Law, PLC

(57) ABSTRACT

A tent shelter of the type that is erected by at least one arch pole and has multiple fabric walls that intersect to form substantially vertical corners when the shelter is erected. At each corner a strut-and-guy line support structure is provided for supporting and tensioning the fabric walls. Each strut structure includes two strut legs, each leg being integrated with a respective wall of a particular corner. The bottom ends of the strut legs are spread apart in the erected state of the shelter but are interconnected by a flexible strap. The top ends of each set of legs converge to form an inverted V shape. A guy line arrangement tensions each of the corners. The tent body can further be strengthened against severe weather by additional arch poles removably secured to the fabric body in an X configuration crossing the center arch and passing over the corners.

20 Claims, 10 Drawing Sheets

OTHER PUBLICATIONS

Buachaille, Terra Nova Laser review and latest UK prices, Buachaille.com, Apr. 10, 2006 (earliest review), 4 pages, www.buachaille.com, U.K. (Internet).

Trailspace, REI Roadster UL reviews and information, Trailspace tent review webpage, Aug. 21, 2005 (earliest review), 4 pages, www.trailspace.com, U.S.

* cited by examiner

STRUT AND ARCH STRUCTURE FOR TENT

FIELD OF THE INVENTION

The present invention is in the field of tent shelters used by hikers, backpackers, and campers.

BACKGROUND OF THE INVENTION AND DESCRIPTION OF RELATED ART

Hikers and backpackers usually require a shelter such as a tent for overnight or multi-night trips. The longer the trip, the greater the need for a shelter of as little packed weight as possible to reduce fatigue, to make room for food and other gear in the pack, and to increase the enjoyment of hiking. But striking the proper balance between reducing the shelter's weight for carrying, while maintaining or increasing its shelter value (ease of set-up, weather resistance, sturdiness, roominess, ventilation, and other factors known to those skilled in the art) is a constant challenge.

Both single- and double-wall tents and shelters have benefited in recent years from the advent of lighter, stronger fabrics for the weatherproof canopy or "fly" portion and (for double-wall tents) the inner-tent portion; and from lighter, stronger poles. Another development has been the introduction of lightweight single-wall shelters primarily consisting of silicone-impregnated nylon or "silnylon" canopies supported by various combinations of trekking and/or arch poles, sometimes floorless but increasingly with insect netting and floors. My own Tarptent™ line of shelters found at www.tarptent.com has included a number of inventive and patented shelter designs using single-wall silnylon canopies, including those disclosed in U.S. Pat. Nos. 7,406,977; 7,146,996; and 7,134,443.

Much of a shelter's weight is concentrated in its poles and reducing pole weight is a key factor in designing lightweight shelters with high space/weight ratios. However, high space/weight ratios are difficult to achieve without compromising stability, useable space, or both. Inwardly sloping walls cut off useable space and long, unsupported fabric spans are inherently less stable than those supported by closely spaced poles. Arch poles maximize interior space and fabric support but are about 3 times heavier than vertical poles of the same height as the arch. Typical dome or tunnel tents require at least two such arch poles. Hence, erecting a shelter can be a time-consuming and complex process requiring pole assembly followed by clipping or threading the pole(s) to the shelter fabric. In a raging storm, time to erect one's shelter is of critical importance.

Single pole shelters—single arch or single vertical pole—minimize weight and setup time but compromise useable space at the canopy edges furthest from the pole. Edges and corners can be raised a few inches above ground with long stakes or long guylines but such edges slope to near ground level, cutting off useable space, and the further the edge from a fixed support, the lower the stability. Another method for both raising and stabilizing the edge is the use of a corner support such as a vertical "strut." If short enough, the strut can be integrated into the canopy structure and rolled up with the shelter for storage, never needing to be reassembled in the field. When held in tension via staking, struts lift and provide direct support (see Hilleberg Atko, Terra Nova Laser, or Tarptent Contrail). Technically, such a structure is no longer single-pole but additional complexity and setup time is minimized while useable space is dramatically improved. However, single struts are only moderately stable without multiple guy lines running from the strut apex to the ground. A single vertical pole (or strut) must have at least 3 equally spaced and angled lines of tension to become stable and thus a single strut at a tent corner isn't stable enough to limit all motion, especially in strong wind.

In view of the above-noted shortcomings of single-arch tents, the standards for "four-season" tents able to withstand severe weather remain multi-pole geodesic or paraboloid designs with multiple crossing poles, and tunnel tents relying on premium-strength poles and canopy fabrics to withstand snow loading. But dome and tunnel type four-season tents tend to be relatively heavy, and in the case of geodesic dome and paraboloid tents they also tend to have lower space-to-weight ratios due to the low-angled curvature of the tent fabric at the sides. Another problem is that strong, multi-pole four-season tents are often regarded as "dedicated" winter tents, being too heavy and complicated to carry and use for the other three seasons of backpacking, when weather is less severe and shelter requirements are reduced.

One type of light, four-season tent of as little weight as possible is the Hilleberg Akto tent, a one-man shelter with a single arch pole bisecting a narrow hexagonal canopy with rectangular walled ends. The walled ends are lower than the center arch, with the end wall corners raised on short straight rods (four total) to provide extra height. While the Akto is generally well regarded for all-around use, its single arch has been reported as being less than ideal for significant snow loading and severe wind, and it is not freestanding. There is no fabric support between the central arch and corners to withstand significant snow, and the single corner struts lack stability.

Accordingly, until now there does not appear to have been a lightweight arch-supported tent capable of withstanding "four season" snow loading and winds while being equally practical and light enough for three-season use. What is needed is a tent shelter with additional pole support when needed for snow loading and severe wind, but where one or more poles can be left at home to save significant weight during less extreme weather. What is also needed is a lightweight support device, in conjunction with a larger support such as a main, central arch, to raise and support the fabric in order to maximize useable space and stability without the need for additional arch poles, and to minimize complexity and risk of breakage.

BRIEF SUMMARY OF THE INVENTION

The invention described herein is an improved support structure adapted for use at the corners of a fabric tent shelter having a center arch support. The term "corner" as used herein refers to the intersection of two fabric walls, substantially but not necessarily perfectly vertical; e.g., the intersection of a side wall and an end wall. Each corner support structure comprises a strut structure made up of two legs which converge at their top ends to form an inverted V-shape, and which are effectively integrated, such as by fabric sleeves, into respective intersecting fabric walls. The corner structure is completed by a guy line that can be staked down and tensioned.

The illustrated embodiment shown in the drawings integrates the strut legs with the fabric walls by means of sleeves formed on the inside surfaces of the shelter walls. The lower ends of the strut legs are joined by a flexible strap or cord, but could be joined by a rigid bottom leg to form a triangular structure as hereinafter described.

The tent body supported and tensioned by the arch and strut structure can be the inner tent or the outer fly of a double-wall tent, or the tent body can be a single-wall canopy. In the preferred form the arch and strut structures are directly connected to the outer, weatherproof fly of a double-wall tent, and the inner tent body is suspended from the arch-and-strut supported fly.

In a further embodiment, the tent body fabric adjacent the V-strut supported corners is further tensioned by supplemental arch poles aligned with and passing above the corners, the supplemental arch poles being connected in tension to the canopy independently of and spaced from the V-strut structures. Using supplemental arch poles crossing from the corners in an "X" over the center arch reinforces the fly to withstand snow loading or high winds, and makes the tent freestanding. In a preferred form, the ends of the arch poles are secured to the corner guy lines above the ground.

In a further embodiment, the V-struts and the fabric end walls are angled outwardly from the center of the tent when properly tensioned.

These and other features and advantages of the invention will become apparent from the detailed description below, in light of the accompanying drawings.

DETAILED DESCRIPTION OF THE INVENTION

Figure 1:
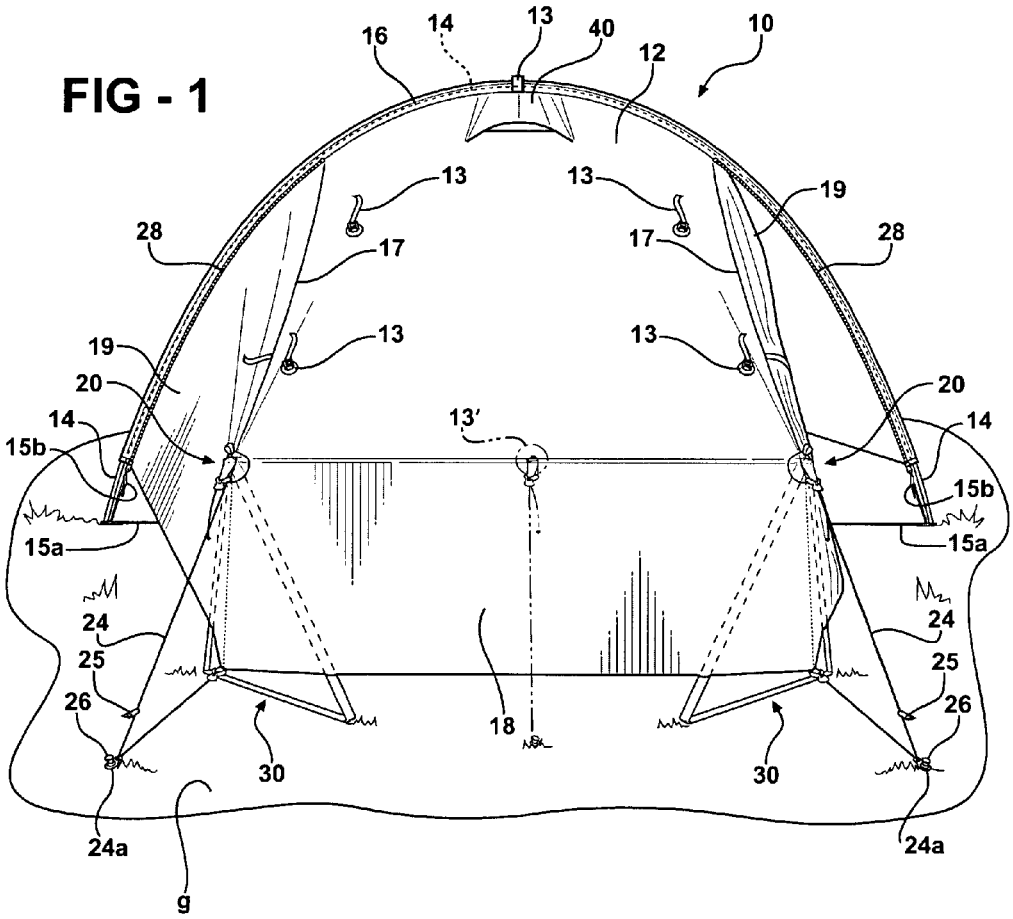
FIG. 1 is an elevation view of one end of a tent using a corner strut structure according to the present invention.
Figure 2:
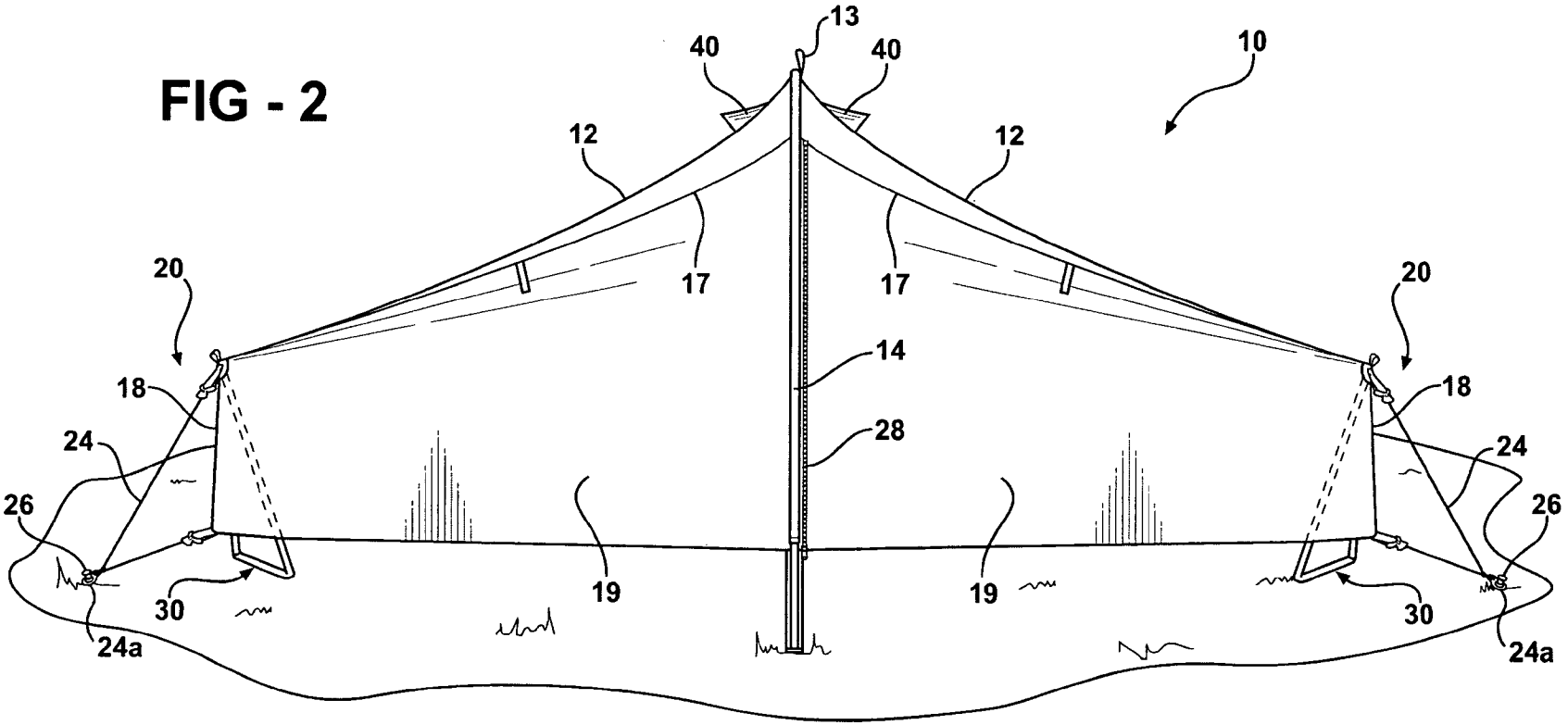
FIG. 2 is a side elevation view of the tent of FIG. 1.

Referring first to FIG. 1, the invention is illustrated in a preferred example comprising a tent shelter 10 having a weatherproof fabric body 12 made from commercially available silnylon material or other suitable fabrics such as coated nylon, coated polyester, spinnaker fabric, cuben fiber, or Tyvek®. Fabric tent body 12 is erected and tensioned by a single center arch pole 14 crossing the tent between walls 19 and fitted through a fabric sleeve 16 or equivalent (clips, mesh sleeve, etc.). The arch pole 14 is stabilized in tension by a ground strap or cord 15*a* crossing under the tent body to connect the ends of pole 14. Tightening straps 15*b* connected between the pole ends and the ends of sleeve 16 can be used to adjust tension. The arch pole 14 is also stabilized in tension by the fabric body 12 itself, via guy lines 24 pulled out and staked to the ground g with stakes 26 at the four corners 20 of the shelter 10. The sleeve 16 or other fabric-attachment structure for securing the arch pole 14 will hereafter be assumed to be part of the center arch pole, and the combined structure of the arch pole 14 and the sleeve 16 will simply be referred to as "arch" or "center arch" for convenience.

The illustrated tent shelter 10 has a narrow hexagonal shape, with two substantially flat, substantially vertical end walls 18 generally parallel to the center arch pole 14 and joined by side walls 19 that are also substantially flat and vertical where they intersect with end walls 18. The arch 14 extends beyond the width of end walls 18 to form the centers of side walls 19 into pointed vestibules extending out from the rectangular sleeping area or inner tent "footprint. Of course, the shape of the tent body overall can vary, including but not limited to squares, rectangles, diamonds (with the end walls 18 coming to a single-corner point at either end), hexagonal and other shapes, provided the tent body has at least two intersecting walls, such as 18 and 19, forming a substantially vertical corner that can be erected and tensioned by an arch and a corner guy line.

It will be understood that the terms "front"/"back" and "end" when used herein to refer to walls or sides are arbitrary and interchangeable.

Conventional entrances can be placed in different locations on the fabric body 12 of shelter 10, although the preferred method is illustrated as a conventional zippered door opening 28, in the illustrated embodiment a straight zipper extending from an upper part of the tent body along the center arch 14 to the lower edge of the tent body. Other locations and known shapes for the zipper opening are also possible, including but not limited to curved or circular zippers. Non-zipper entrances, openings, and windows are also possible.

The tent 10 can include vents, for example peak vents 40 adjacent the top of the arch 14. Peak vents 40 can be of known type, and can be optional.

Figure 3:
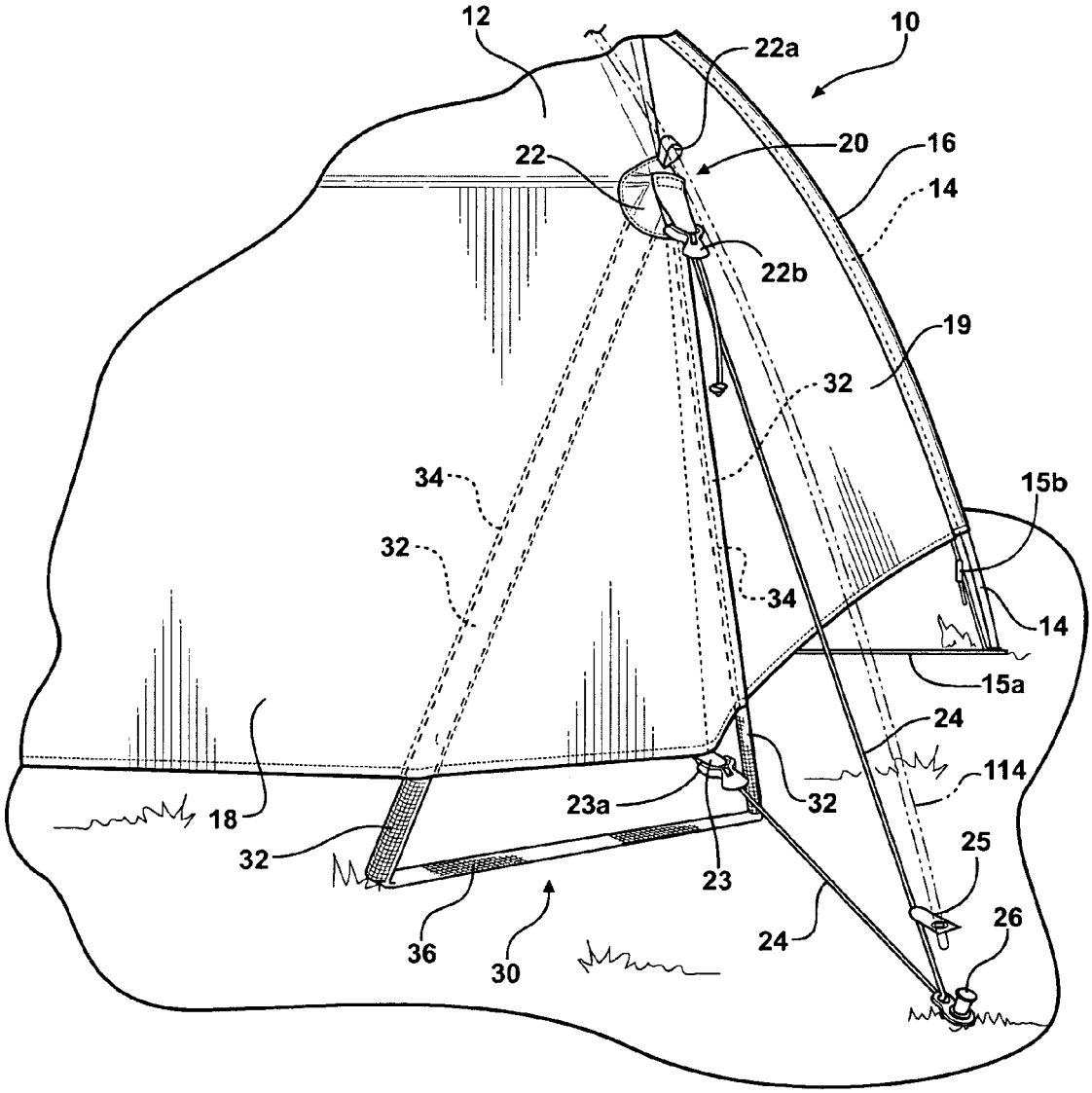
FIG. 3 is a detail perspective view of one of the tent corners and the associated strut structure of FIG. 1.

Referring now to FIGS. 1-4, the details of a corner structure according to the present invention will be described. FIG. 3 is a detailed view of the corner strut structure 30 that gives fabric end walls 18 and corners 20 support and shape, and of the guyline attachment 24 to corner 20. Strut structure 30 includes two strut legs 32, each leg 32 being integrated into a respective fabric wall 18, 19 of the corner 20. The lower ends of the strut legs 32 are spaced apart, but connected by a strap 36, and rest on the ground. Although not connected to each other, the upper ends of the strut legs 32 converge toward the upper end of corner 20, forming a triangular or inverted V-shape. In the illustrated embodiment, the strut legs 32 are secured in fabric sleeves 34 sewn to the inner faces of the fabric walls 18 and 19. In the illustrated embodiment the lower ends of the sleeve/strut combination extend below the lower edges of walls 18 and 19 to keep the lower edges of the tent body raised a few inches off the ground. It will be understood, however, that varying schools of thought exist as to the best height for the lower edges of the tent body relative to the ground, often depending on the weather conditions for which the tent is designed, and so the lower ends of the struts 32 and sleeves 34 could also be even with the lower edges of the tent body for a flush fit to the ground, or in the case of a tent whose lower fabric edges are intended to be buried as sand/snow flaps could even terminate above the lower fabric edges of the tent body.

Strut legs 32 can be made from any known material commonly used for tent poles and struts, for example short lengths of aluminum tubing, carbon-fiber rods, fiberglass rods, stiff plastic rods, etc. It will also be understood that while a cylindrical tube or rod shape is preferred, non-cylindrical or nontubular shapes such as flat slats or battens can be used. The important thing is that the struts 32 be relatively rigid and stiff enough to provide support and tension to the fabric walls of the tent body at corner 20. The lower ends of the struts 32 are connected by a flexible strap such as 36 to positively limit the distance they can be spread apart in tension by the fabric walls 18 and 19 when the tent is staked out. By forming the struts 30 as separate legs 32 joined only by a flexible strap 36, they can be collapsed and rolled up with the shelter 10. Therefore this is the preferred, but not the only, way to form the strut structures 30. For example, the strut structure 30 could use a rigid, removable connector leg instead of a strap to join the lower ends of strut legs 32 when the tent shelter is erected.

Figure 4:
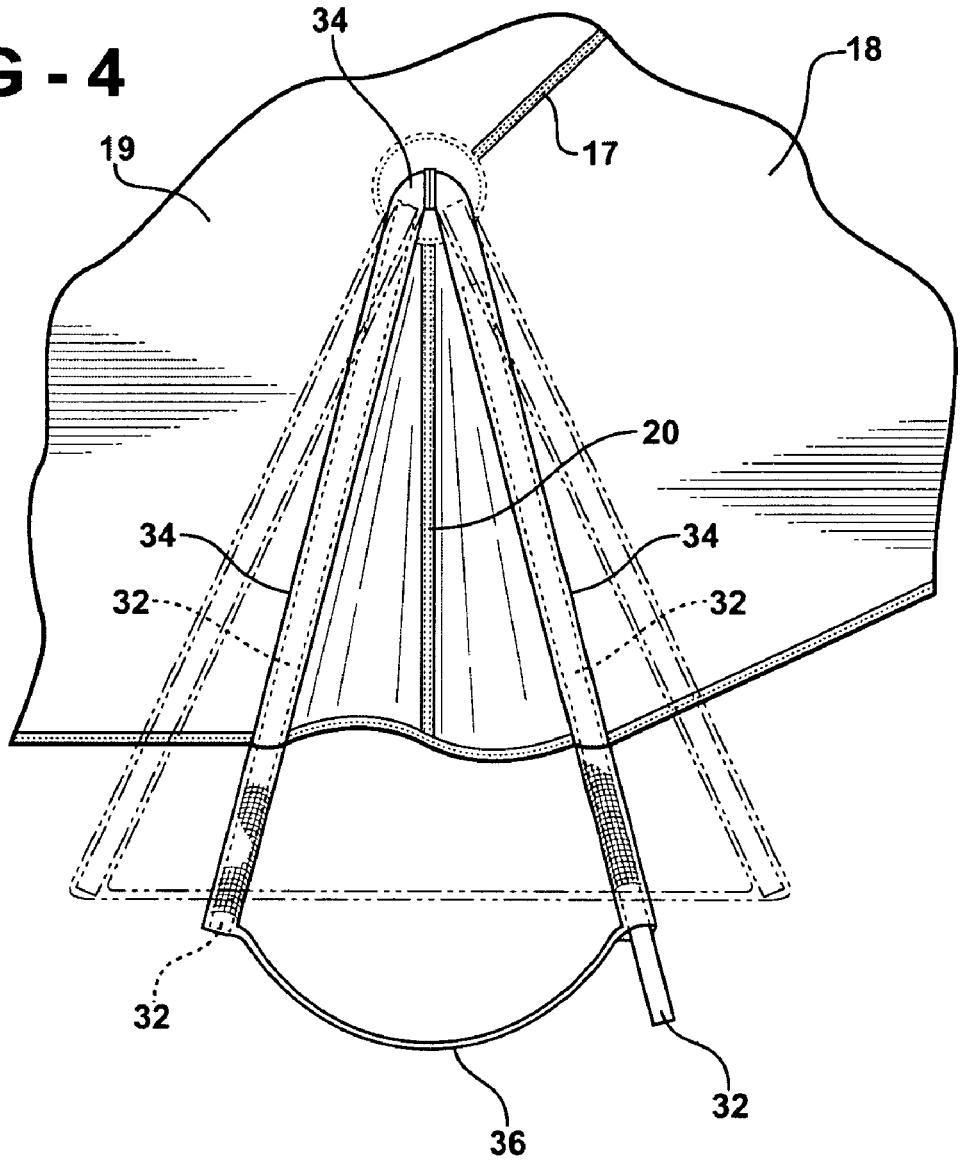
FIG. 4 is a view of the inside fabric of a corner of the tent in FIG. 1, showing a preferred sleeve structure for attaching the strut legs to the corners, with one of the strut legs shown partially inserted in its sleeve.

FIG. 4 is a direct view of the inside faces of fabric walls 18 and 19 where they intersect at corner 20, and of the sleeve-enclosed strut legs 32 where they are sewn to the fabric. FIG. 4 also shows one of the strut legs 32 partially inserted in its sleeve 34. Illustrated sleeve 34 is made from lightweight nylon webbing folded lengthwise and sewn into a tube with two end openings for the struts, and then sewn into the fabric walls of the tent body. The strut legs 32 are then inserted in the sleeve 34 to form the strut structure 30. In a preferred form, the length of sleeve 34 is longer than the combined length of the inserted strut legs 32, such that the unfilled ends of the sleeve can be removably or permanently connected to form the connecting-strap 36. The manner of construction of sleeve 34 and connecting-strap 36 can vary, however, and they do not have to be formed separately from the tent body and subsequently attached, and they do not have to be an integral piece of material. For example, connecting strap 36 could be a detachable piece of cord, or a detachable or permanent connector of a more rigid nature than a cord or strap; sleeve 34 could be two separate sleeves of tent body material in their respective corner-forming walls, or sleeve equivalents (such as clips) capable of connecting the struts 32 to the fabric walls.

It will be understood that while it is highly preferred that the lower ends of struts 32 are connected as shown to positively limit their spread, it is also possible to leave them unconnected, provided that the lower ends of the struts 32 are secured in place in their spread apart position. For example, the lower ends of strut legs 32 could be secured to the tent floor using grommets, or could be staked into the ground, or could be jammed into the ground or snow.

Strut legs 32 can be sealed permanently in sleeve(s) 34 by sewing or other means, or the ends of sleeve(s) 34 could be left open, or provided with a removable cover or flap, so that strut legs 32 can be removed and replaced as needed.

Still referring to FIG. 4, the separate, independently movable connection of the strut legs 32 to their respective fabric walls allows the legs to be folded or rolled up or stuffed with the tent body fabric without having to remove them from the tent body. When the tent body is set up in tension (phantom lines), the strut legs 32 tend to function as a single strut structure acting on fabric corner 20 because they are pulled apart evenly in tension by the fabric side and end walls 18 and 19. When that tension is released (solid lines), the rigidity of the strut structure 30 is lost and the struts are free to move independently, constrained only by their connection to their respective walls of the tent fabric via sleeve(s) 34.

Figure 3A:
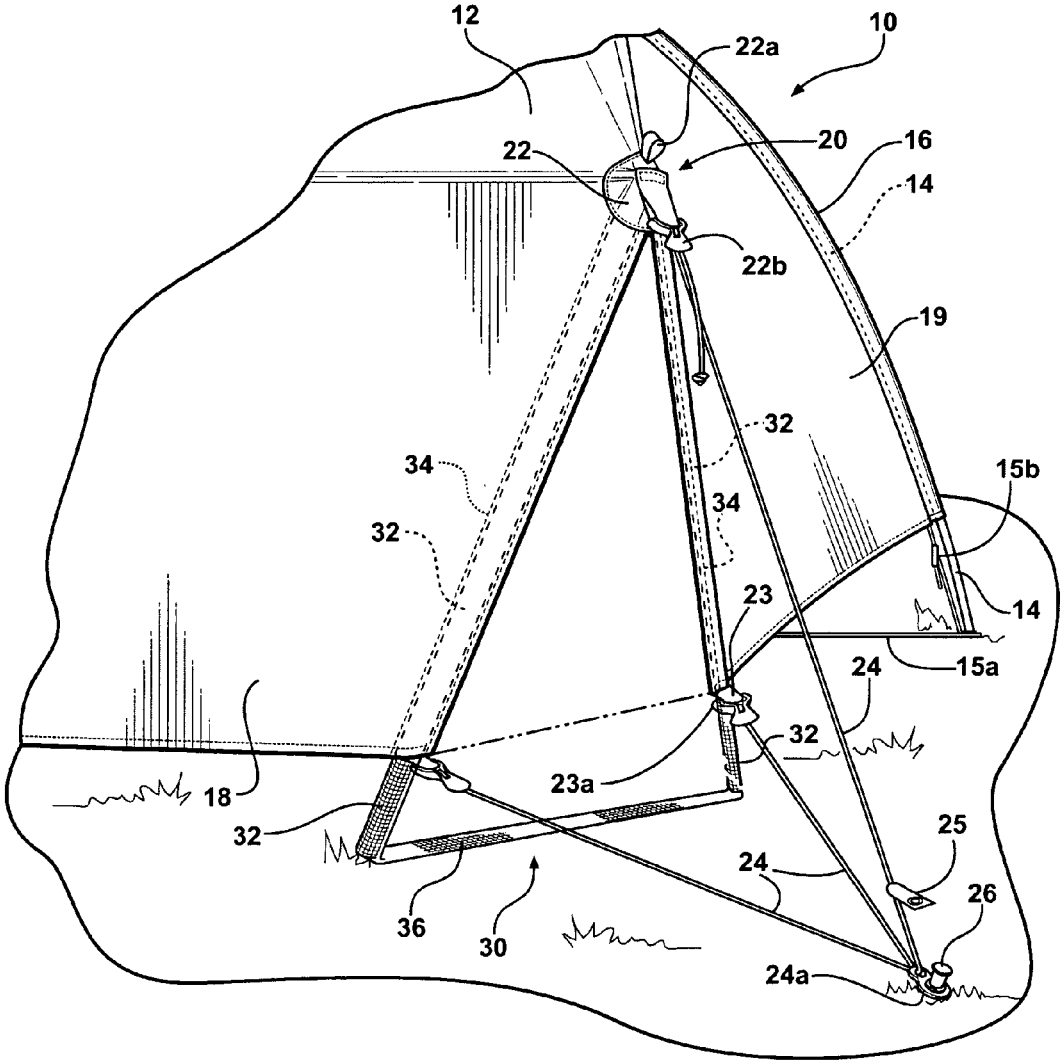
FIG. 3A is similar to FIG. 3, but shows an alternate corner structure for the tent fabric.

Referring again to FIG. 3, tent 10 is set up in tension and the strut structure 30 is supporting and tensioning the corner 20 in conjunction with guyline 24 secured to the upper and lower ends of corner 20 and staked into the ground at 26. As stated above, "corner" refers to the substantially vertical junction of the end and side walls 18 and 19, and not just the upper and lower ends or points of the junction. But the substantially vertical corner need not be limited to a true or full intersection of adjacent walls for struts 30 to function. For example, as shown in FIG. 3A, the fabric walls 18 and 19 could end at their respective strut legs 32, with an triangular open space or a flat triangular panel of fabric (shown in phantom lines) between the strut legs, although in such cases it would be highly desirable to tension a lower portion of each strut leg 32 with cording (illustrated as additional guy lines 24), straps, or stakes, or with connections to a tent floor, in order to maintain the V structure and prevent if from folding inward or pinching together. So while a full corner defining a vertical line or seam with upper and lower guyline attachment points as illustrated in FIG. 3 is preferred, other intersecting wall arrangements are possible.

The upper end of corner 20 is reinforced with a patch of strong fabric 22, such as vinyl or heavy nylon, to better secure the upper pullout loop 22*a* to the relatively thin fabric of the tent body, and to provide a reinforced sewing attachment point for the upper end of strut sleeve 34. The lower pullout loop 23 can be sewn or otherwise fastened directly into the tent body material, or provided with its own reinforcement patch (not shown). While guyline 24 is shown as a double-ended line secured in the middle by stake 26 and tied or clipped at each end to the upper and lower ends of corner 20, it will be understood that a single guyline with a single attachment point to the upper end of corner 20 could be used (with the bottom end of the corner secured in some other fashion, for example by staking directly to the ground), or that multiple guylines with multiple attachment points could be used, although the illustrated two-point corner attachment with a single guyline connected to upper and lower portions of the corner is preferred.

Upper and lower pullout loops 22*a* and 23 are preferably provided with guy line tighteners 22*b*, 23*b* of known type, to independently tension and adjust the upper and lower portions of fabric corner 20 through guy line 24. As shown in the Figures, the optimal adjustment results in the upper end of V strut 30 being angled outwardly, while the fabric corner 20 remains more vertical due to the tension exerted by the guy line 24 on the lower portion of the corner through lower pullout loop 23. Both the strut 30 and the fabric corner 20 can be considered substantially vertical, for example being generally less than forty-five degrees from vertical.

It will be understood that while the strongest fabric-supporting and tensioning structure is achieved when the lower ends of strut legs 32 are spread to their maximum as shown in the Figures, it is possible to adjust the spacing of their lower ends for different effects on the height and tension of the fabric tent body.

Figure 5:
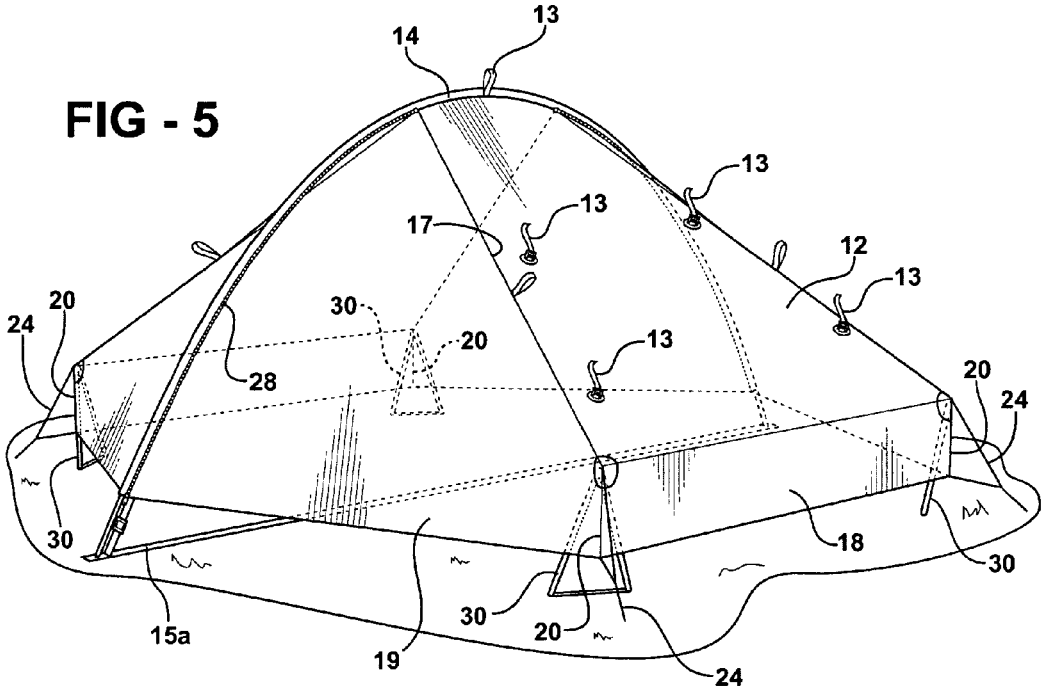
FIG. 5 is a perspective schematic view of the tent of FIG. 1.
Figure 5A:
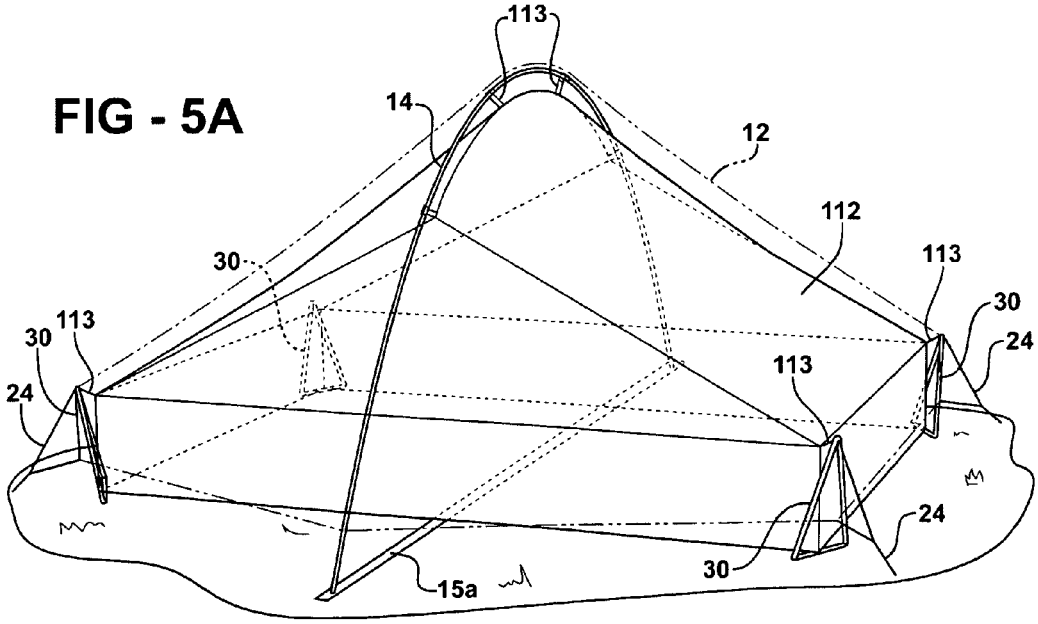
FIG. 5A is a perspective view of FIG. 5 with the fly removed, and an inner tent supported by a single center arch and the corner struts.
Figure 5B:
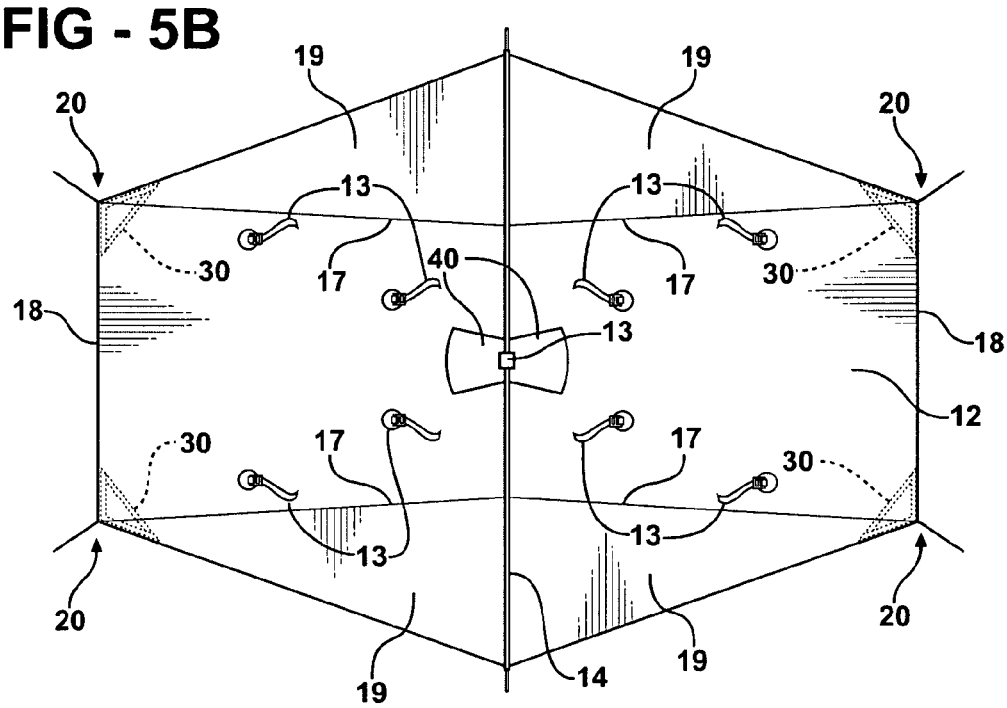
FIG. 5B is a top plan view of FIG. 5.

FIG. 5 is a perspective view of the currently preferred form of shelter 10, with the fabric body 12 comprising a narrow hexagon (in plan view) with a wider, higher middle portion at arch 14 and lower, narrower, rectangular end walls 18. FIG. 5 shows tent body 12 as a single-wall waterproof canopy set up over bare ground or snow and tensioned with the combination of arch 14 and corner strut structures 30. It will be understood that an inner tent having a waterproof floor and non-waterproof walls can be coupled to outer "fly" 12, preferably in detachable manner, for example with a series of mating elastic loops and toggles or clips formed on the respective inner and outer surfaces of the fly and inner tent. FIG. 5A shows just such a double-wall arrangement, with the outer tent body 12 in phantom to better show the inner tent 112 suspended from the outer body's arch and strut-supported structure with loops 113. FIG. 5B shows an idealized regular hexagonal shape for the tent body 12.

While inner tent 112 in FIG. 5A is shown with a preferred rectangular "footprint" matching the rectangle defined by outer tent body end walls 18, it will be understood that the inner tent 112 can take other configurations. For example, inner tent 112 can match the hexagonal area covered by outer fabric body 12; or it could cover less than the rectangular area defined by the end walls 18 in order to create a greater floorless vestibule area under the protection of the outer fly for storing wet gear, cooking, etc.; or it could be a floorless insect netting or condensation-reducing insert.

Figure 6B:
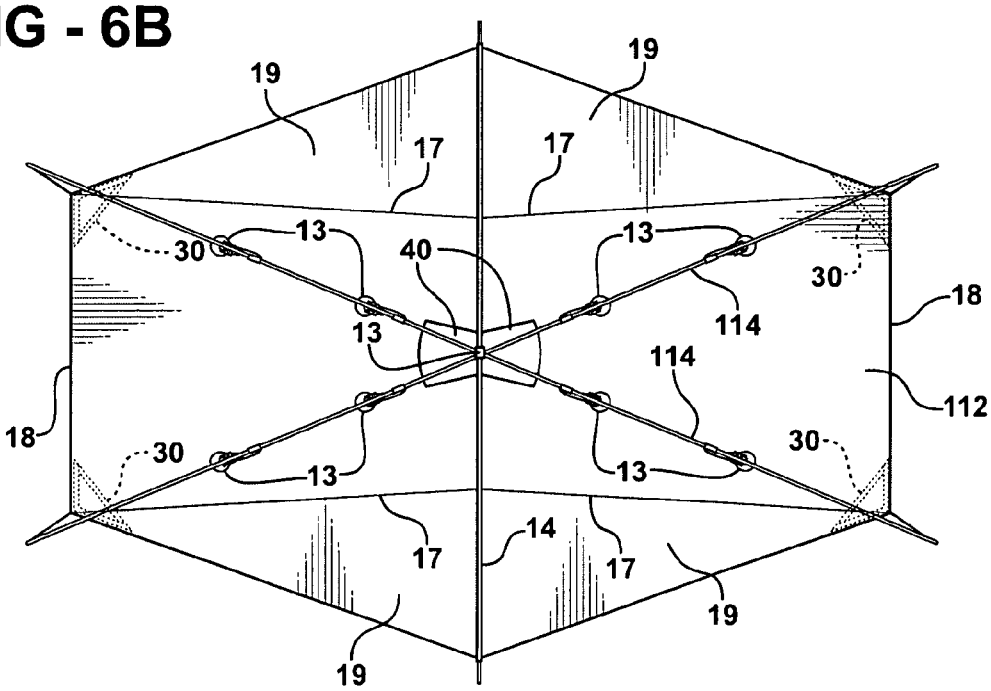
FIG. 6B is a top plan view of FIG. 6A.
Figure 6:
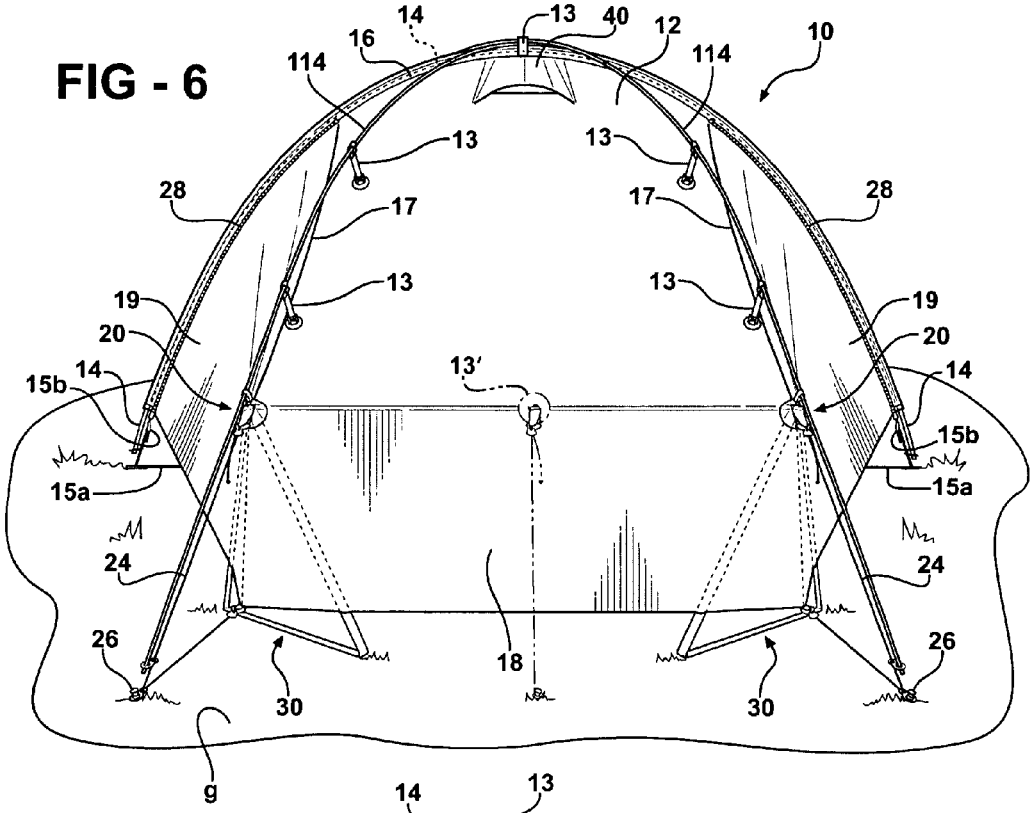
FIG. 6 is an end elevation view of the tent of FIG. 1, modified with two additional, crossing arch poles.
Figure 6A:
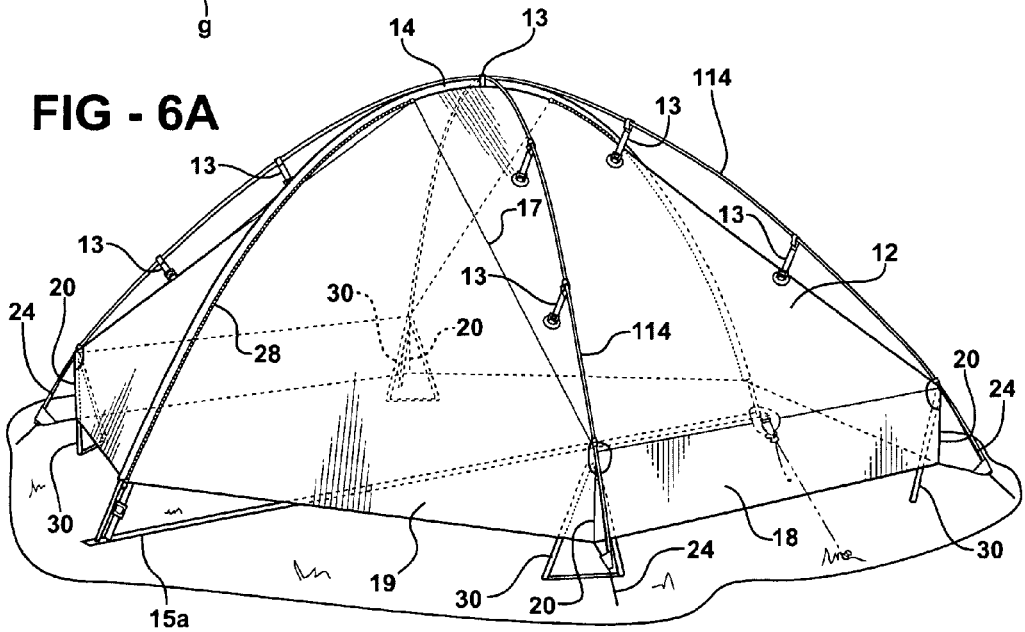
FIG. 6A is a perspective schematic view of the modified three-pole tent of F*ig*. 6.

FIGS. 6, 6A, and 6B show tent 10 modified with the addition of two extra arch poles 114, added in a crossing X configuration passing above fabric body structural seams 17 and over corners 20. The ends of poles 114 can be anchored in various ways, including the known technique of providing a grommeted strap extending from the tent floor or lower edge of the fly, but the preferred way according to the invention is to incorporate a pole-receiving structure such as a grommet or pole cup or pocket 25 in each corner guy line 24, for example by sewing or knotting the pole-receiving structure 25 to the upper guy line, in order to securely receive the ends of the poles 114. Poles 114 are secured in tension to the tent body fabric by loops or clips 13 secured to the fabric at the apex of the center arch 14 and along suitably reinforced portions of the canopy roof determined to evenly lift and tension the fabric, and by loops 22*a* adjacent the corners 20. The addition of poles 114 makes fabric tent body 12 (the outer waterproof fly portion of the tent) strong enough to withstand significant snow loading, and also makes the fabric more stable in windy conditions.

Figure 3B:
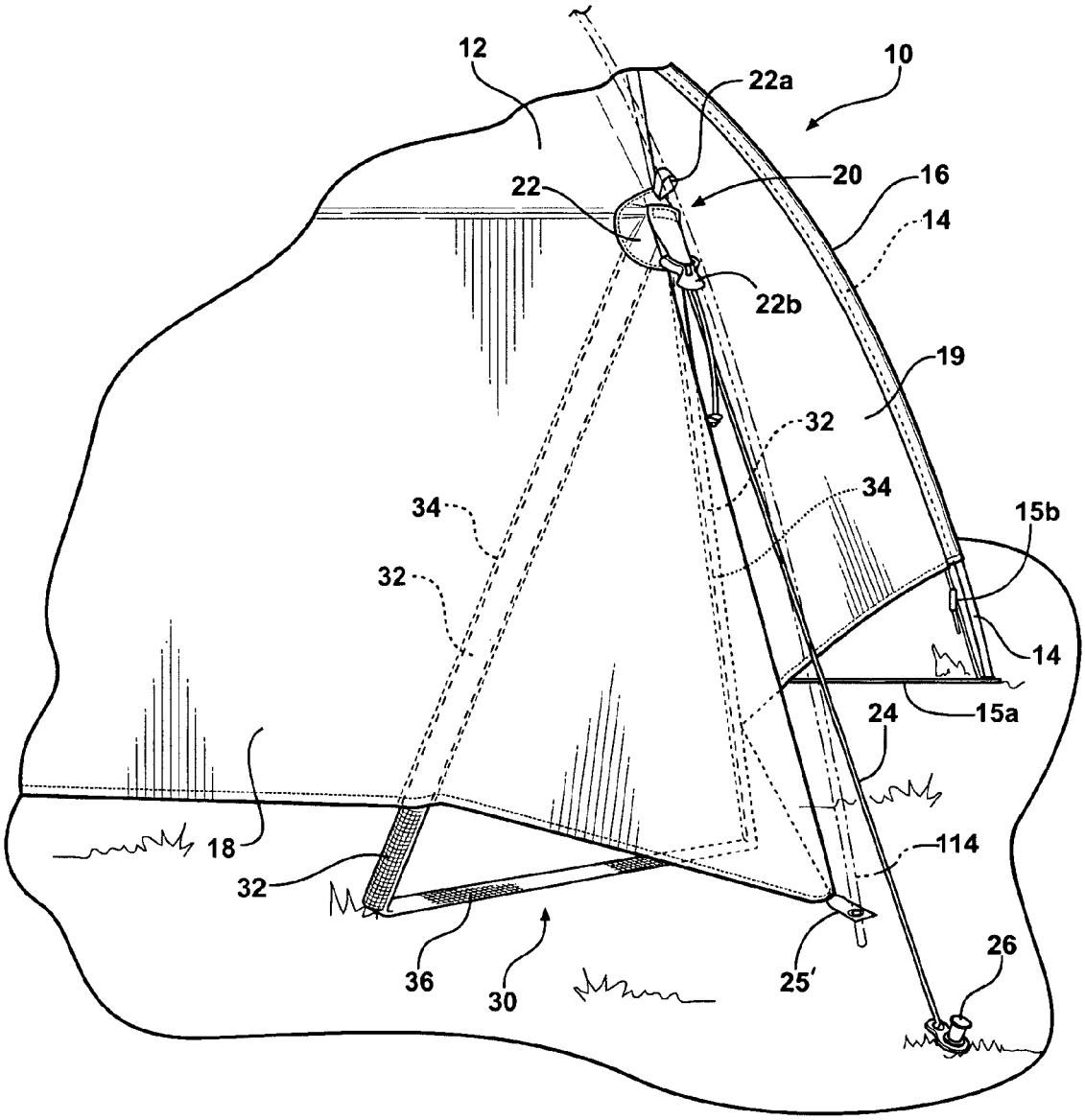
FIG. 3B is similar to FIG. 3, but shows an alternate pole-receiving structure in the tent fabric at the corner.

FIG. 3B illustrates an alternate pole-receiving structure using a portion of fabric corner 20, in which a grommet or similar pole-receiving structure 25' is anchored in the tent corner fabric rather than in the guy line. In order to avoid having to use a compound bend or angle in pole 114, this is achieved in FIG. 3B by extending the lower part of fabric corner 20 outwardly toward stake 26. Using a downwardly-angled joint or pre-bent section in pole 114 near the point where it passes over the upper part of corner 20 would reduce or eliminate the need to extend the corner fabric outwardly. Although grommet 25' is shown above the ground when pole 114 is secured therein, without a guy line attachment to stake 26, it would be possible to put an additional guy line connection between grommet 25' or an adjacent part of the fabric corner to stake 26 (or to an additional stake), in order to further tension the pole end in place.

The illustrated off-the-ground location of the ends of poles 114, secured in tension to two points spaced over corner 20, provides a freestanding support to the tent shelter even when guy lines 24 are not staked down. It would also be possible to place grommet 25 or grommet 25' at ground level so that the end of pole 114 secured in the grommet is essentially on the ground when secured in the grommet.

It will be understood that although the additional arch poles 114 are shown supplementing a tent shelter using the inventive corner strut structures 30, they could also be added to and used to strengthen the snow-loading capacity and wind stability of such an arch-supported shelter using unsupported or conventionally-supported corners. However, struts 30 and the pole-receiving guy lines 24 (or modified corners as in FIG. 3B) provide the unique freestanding structure illustrated when poles 114 are used, and provide superior stability.

While loops or clips are currently the preferred form for securing cross-poles 114 to the fabric canopy in tension, it will be apparent to those skilled in the art that other known means for attaching poles to tent canopies can be used, such as fabric sleeves.

Figure 7:
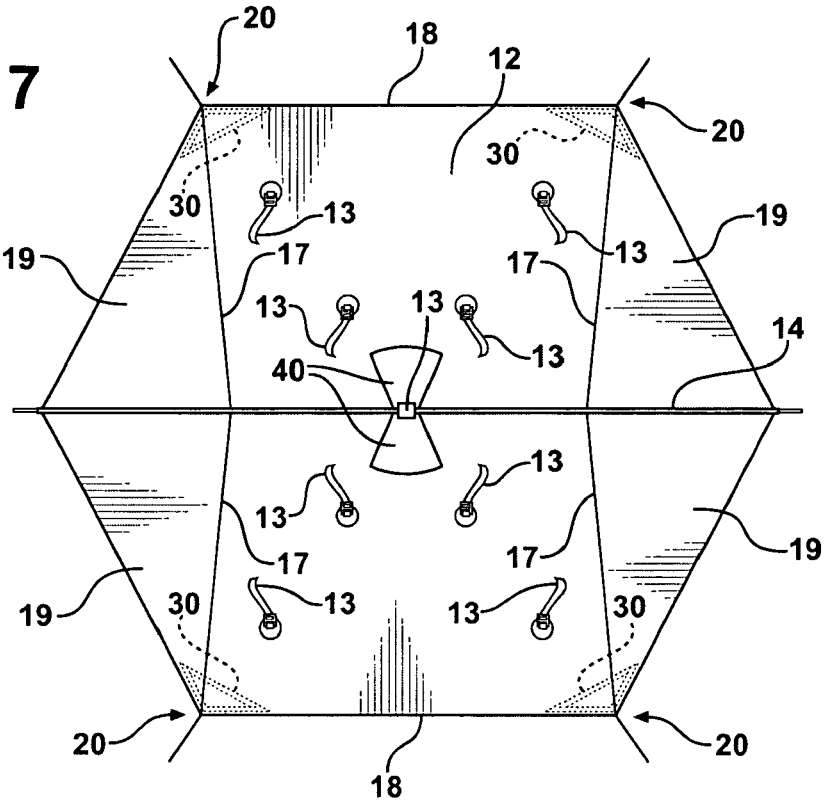
FIG. 7 is a top plan view of a tent similar to that shown in FIG. 1, but widened to hold two or three people.
Figure 8:
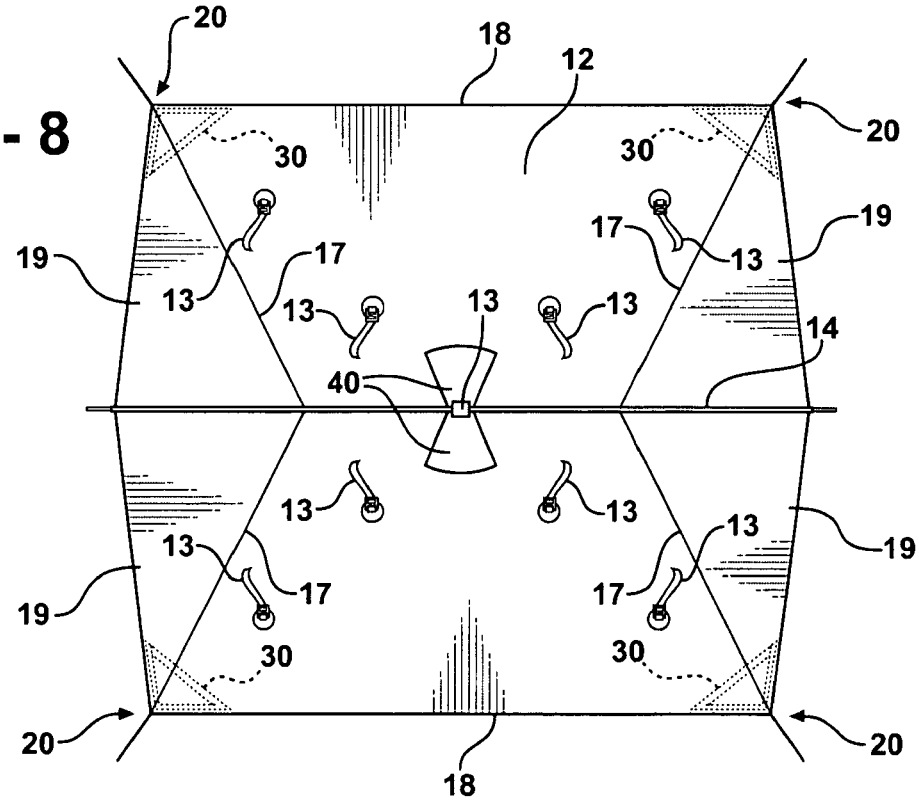
FIG. 8 is a top plan view of a tent similar to that shown in FIG. 1, but further widened to hold four people.

FIGS. 7 and 8 show tent shelters similar to tent shelter 10 in FIGS. 1-6, except that the shelters in FIGS. 7 and 8 have wider end walls 18 (and correspondingly longer arch poles) to accommodate more people. The FIG. 6 shelter, for example, might be a solo shelter, the FIG. 7 shelter might house two or three people, and the FIG. 8 shelter might be a four-person shelter. Of course, other dimensional variations are possible.

It will finally be understood that the disclosed embodiments are representative of presently preferred forms of the invention, but are intended to be explanatory rather than limiting of the invention. Reasonable variation and modification of the invention as disclosed in the foregoing disclosure and drawings are possible without departing from the scope of the invention. The scope of the invention is defined by the following claims.

What is claimed:

1. In a fabric tent shelter of the type comprising at least two substantially vertical fabric walls which intersect to form a substantially vertical corner and a center arch pole for erecting the shelter, the center arch pole defining an arch plane spaced from the substantially vertical corner when the shelter is erected, a fabric-supporting corner structure comprising:

first and second substantially stiff strut legs, each strut leg comprising a top end and a bottom end;

the first strut leg being integrated with one fabric wall so as to be substantially coplanar therewith;

the second strut leg being integrated with the other fabric wall so as to be substantially coplanar therewith;

the top ends of the strut legs converging into close proximity at an upper portion of the corner when the shelter is erected;

the bottom ends of the strut legs being spaced apart when the shelter is erected; and a guy line extending from the shelter proximate the corner to tension the corner strut structure against the center arch pole at a non-coplanar angle to the arch plane when the shelter is erected.

2. The structure defined in claim 1 wherein the lower ends of the strut legs are connected.

3. The structure defined in claim 2 further comprising a flexible strap connecting the lower ends of the strut legs.

4. The structure defined in claim 1 further comprising fabric sleeves associated with the walls for receiving the strut legs.

5. The structure of claim 1 wherein the guy line is connected to the shelter proximate upper and lower portions of the corner.

6. The structure of claim 1, further comprising an additional arch pole crossing over the fabric-supporting corner structure and over the center arch pole.

7. The structure of claim 6, wherein the additional arch pole has an end secured in tension to the guy line.

8. The structure of claim 1, wherein the fabric walls intersect between the strut legs to form the corner.

9. The structure of claim 1, wherein the fabric walls intersect at the strut legs to form the corner.

10. The structure of claim 1, wherein at least one of the fabric walls or the corner is tensioned at an angle substantially orthogonal to the arch plane when the shelter is erected.

11. A tent shelter comprising:

a plurality of fabric walls which intersect to form corners;

a center arch pole for erecting the shelter such that the corners are substantially vertical, the center arch pole defining an arch plane when the shelter is erected and the corners being spaced from the arch plane when the shelter is erected;

fabric-supporting structures at the corners, each fabric-supporting structure comprising first and second substantially stiff strut legs associated with a respective corner, each leg comprising a top end and a bottom end;

the first strut leg being integrated with one fabric wall adjacent its respective corner so as to be substantially coplanar therewith;

the second strut leg being integrated with the other fabric wall adjacent its respective corner so as to be substantially coplanar therewith;

the top ends of the strut legs converging when the shelter is erected into close proximity at an upper portion of its respective corner;

the bottom ends of the strut legs being spaced apart when the shelter is erected; and, a guy line extending from the shelter proximate a portion of each corner to tension the corner against the center arch pole at a non co-planar angle to the arch plane when the shelter is erected.

12. The structure defined in claim 11 wherein the bottom ends of the strut legs are connected.

13. The structure defined in claim 12 further comprising a flexible strap connecting the bottom ends of the strut legs.

14. The structure defined in claim 11 further comprising fabric sleeves associated with the walls for receiving the strut legs.

15. The structure of claim 11 wherein the guy line is further connected to the shelter proximate a lower corner portion.

16. The structure of claim 11, further comprising an additional arch pole crossing over one or more of the corner-supporting strut structures and over the center arch pole.

17. The structure of claim 16, wherein the additional arch pole has ends secured in tension to each guy line.

18. The structure of claim 11, wherein the fabric walls intersect between the strut legs to form the corners.

19. The structure of claim 11, wherein the fabric walls intersect at the strut legs to form the corners.

20. The structure of claim 11, wherein at least one of the fabric walls or corners is tensioned at an angle substantially orthogonal to the arch plane when the shelter is erected.

* * * * *